US008522394B2

(12) United States Patent
Lee et al.

(10) Patent No.: US 8,522,394 B2
(45) Date of Patent: Sep. 3, 2013

(54) HOSE AND ACCESSORY HOLDER FOR AN UPRIGHT VACUUM CLEANER

(75) Inventors: Byung-Jo Lee, Gwangju (KR); See-hyun Kim, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 559 days.

(21) Appl. No.: 12/755,129

(22) Filed: Apr. 6, 2010

(65) Prior Publication Data

US 2010/0325831 A1 Dec. 30, 2010

(30) Foreign Application Priority Data

Jun. 25, 2009 (KR) ..... 10-2009-0056785

(51) Int. Cl.
*A47L 5/00* (2006.01)

(52) U.S. Cl.
USPC ..... 15/323; 15/327.1; 15/327.2; 15/414; 248/75; 248/230.7

(58) Field of Classification Search
USPC ..... 15/323, 327.1, 327.2, 414; 403/348, 403/349, 350, 351, 359.3, 359.4; 211/66, 211/60.1, 70.6; 248/51, 65, 73, 74.2, 75, 248/230.1, 230.7; 24/339, 457
See application file for complete search history.

(56) References Cited

U.S. PATENT DOCUMENTS

| | | | | |
|---|---|---|---|---|
| 2,272,688 | A * | 2/1942 | Catron | 248/27.1 |
| 2,643,581 | A * | 6/1953 | Wehrenfennig | 396/531 |
| 3,872,538 | A * | 3/1975 | Crouser | 15/323 |
| 5,456,095 | A * | 10/1995 | Tawil et al. | 63/29.1 |
| 5,460,342 | A * | 10/1995 | Dore et al. | 248/74.2 |
| 5,582,199 | A * | 12/1996 | Schmidt et al. | 137/360 |
| D444,603 | S * | 7/2001 | Murphy et al. | D32/31 |
| 6,345,407 | B1 * | 2/2002 | Jupp | 15/323 |
| 7,086,630 | B2 * | 8/2006 | Maruyama | 248/71 |
| 7,207,528 | B2 * | 4/2007 | Kato | 248/55 |
| 7,328,873 | B2 * | 2/2008 | Suzuki et al. | 248/68.1 |
| 7,984,883 | B2 * | 7/2011 | Li et al. | 248/125.7 |
| 2002/0063190 | A1 * | 5/2002 | Buck | 248/74.1 |
| 2003/0024067 | A1 * | 2/2003 | Roney et al. | 15/323 |
| 2004/0045127 | A1 * | 3/2004 | Albert et al. | 15/415.1 |
| 2004/0188570 | A1 * | 9/2004 | Bauer | 248/68.1 |
| 2007/0271727 | A1 | 11/2007 | Adams | |

FOREIGN PATENT DOCUMENTS

| | | |
|---|---|---|
| KR | 10-1997-0020029 | 5/1997 |
| KR | 10-2001-0043380 | 5/2001 |
| WO | WO 99/56609 | 11/1999 |

* cited by examiner

*Primary Examiner* — Mark Spisich
*Assistant Examiner* — Andrew A Horton
(74) *Attorney, Agent, or Firm* — NSIP Law

(57) ABSTRACT

A hose and accessory holder for an upright vacuum cleaner comprises a tool fixing portion having accessory tools insertable thereinto, a hose fixing portion for attachably/detachably fixing a hose thereto, and a holder fastening portion for attachably/detachably fastening the holder to a vacuum cleaner body. The tool fixing portion further comprises fitting members respectively formed in the insertion directions of the accessory tools on inner circumferential surfaces of the tool fixing portion, and protruding inwardly from the tool fixing portion.

13 Claims, 5 Drawing Sheets

HOSE AND ACCESSORY HOLDER FOR AN UPRIGHT VACUUM CLEANER

CROSS-REFERENCE TO RELATED APPLICATION(S)

This application claims the benefit under 35 U.S.C. §119 (a) of Korean Patent Application No. 10-2009-56785, filed on Jun. 25, 2009, in the Korean Intellectual Property Office, the entire disclosure of which is incorporated herein by reference for all purposes.

BACKGROUND

1. Field

The following description relates to a hose and accessory holder for an upright vacuum cleaner, and to an upright vacuum cleaner having such a holder.

2. Description of Related Art

In general, a vacuum cleaner provides a suction force generated by a fan mounted in a vacuum cleaner body to a nozzle unit via a hose and an extension pipe. The suction force sucks dust from a floor into the nozzle unit, and collects the dust in a dust-collecting receptacle mounted in the vacuum cleaner body, thereby performing cleaning.

In an upright vacuum cleaner, a user performs cleaning using a main nozzle unit when cleaning a floor, and performs cleaning using an auxiliary suction nozzle when cleaning a narrow area that cannot be cleaned using the main nozzle unit. The auxiliary suction nozzle is connected to the vacuum cleaner body via a hose and an extension pipe, and different accessory tools may be connected to the free end of the extension pipe in accordance with the type of area to be cleaned. The most widely used accessory tools are a brush tool and a crevice tool. Such accessory tools require a holder when they are not in use.

When a vacuum cleaner is not in use, or when performing cleaning using the main nozzle unit a hose holder is needed for fixing the hose used to connect an auxiliary suction nozzle when that auxiliary suction nozzle is not in use.

Conventionally, in order to improve convenience in carrying accessory tools, an accessory holder mounted on a hose has been proposed. Korean Patent Publication No. 2001-0043380, discloses a tool holder that is connected to a hose, and allows an accessory tool to be inserted in socket fashion thereinto. Since the tool holder surrounds the entire hose, it is inconvenient to attach/detach the tool holder, and the tool holder cannot be connected to a vacuum cleaner body.

Korean Patent Publication No. 1997-0020029 discloses a hose holder mounted on a handle portion. However, an accessory tool cannot be inserted into the hose holder, and the hose holder tends to be detached from the handle portion due to movement of the hose.

SUMMARY

An aim of embodiments is to provide a hose and accessory holder, which permits a hose to be fixed thereto, which can hold accessory tools, and can allow the hose to be selectively connected to a vacuum cleaner body.

Embodiments aim to provide a hose and accessory holder, which can facilitate insertion of a hose and accessory tools, and can prevent the hose and accessory tools from sliding or coming off due to movement of the vacuum cleaner after they are inserted and tightly fastened to the vacuum cleaner body.

Embodiments provide a hose and accessory holder for a vacuum cleaner, the holder including: a tool fixing portion for insertion of accessory tools, a hose fixing portion for attachably/detachably fixing a hose thereto, and a holder fastening portion for attachably/detachably fastening to a vacuum cleaner body, wherein the tool fixing portion further includes fitting members formed in the respective insertion directions of the accessory tools on inner circumferential surfaces of the tool fixing portion, and protruding inwardly from the tool fixing portion.

The tool fixing portion may further include a stopper protruding in a direction vertical to the fitting member at the center of the inner circumferential surface of the tool fixing portion so as to adjust the insertion lengths of the accessory tools.

The hose fixing portion may further include at least one anti-slide member protruding inwardly from the hose fixing portion. Accordingly, it is possible to prevent the hose connected to the hose fixing portion from being slid in the axial direction thereof due to movement of the vacuum cleaner.

The holder fastening portion may include a cylindrical fastening member, and may have fixing projections and guide projections formed on outer circumferential surfaces thereof. A pair of the fixing projections may be formed to be symmetrical with each other in the horizontal direction of the fastening member, and a pair of the guide projections may be formed to be symmetrical with each other in the vertical direction of the fastening member.

The fastening member may be provided on a base member formed on an outer circumferential surface of the hose fixing portion, and a reinforcing rib may be formed at the connection portion of the hose fixing portion and the tool fixing portion. Accordingly, the structure of the holder is strong, and it is possible to prevent the holder from being deformed.

The holder may be such that it can be fastened to the vacuum cleaner body by forming a fastening hole case on the vacuum cleaner body, inserting the holder into the fastening hole case, and then rotating the holder through a predetermined angle.

The fastening hole case may be provided at one side surface of the vacuum cleaner body, the holder fastening portion being inserted into the fastening hole from the outside of the fastening hole case. Hole extension portions may be provided on the outer circumferential surface of the fastening hole, the fixing projections being respectively inserted into the hole extension portions; and fixing projection support portions are formed on said outer circumferential surface for respectively supporting the fixing projections during fastening, and guide grooves are formed on said outer circumferential surface for respectively guiding the guide projections for movement from insertion positions to fastening positions.

Embodiments also provide an upright vacuum cleaner having a vacuum cleaner body, a main nozzle unit, an auxiliary suction nozzle, and a hose and accessory holder provided with a first unit by means of which a hose and accessory tool(s) are attachably/detachably connectable to the holder, and a second unit by means of which the holder is attachably/detachably connectable to the vacuum cleaner body.

The second unit is connectable to the vacuum cleaner body when the hose and accessory tool(s) are inserted into the holder, when the vacuum cleaner is not in use, or when cleaning using the main nozzle unit; and the first unit is separatable from the vacuum cleaner body for connection to the hose, or for permitting only the hose to be separated therefrom when the holder is fastened to the vacuum cleaner body, when cleaning using the auxiliary suction nozzle.

Other features and aspects will be apparent from the following detailed description, the drawings, and the claims.

Figure 1:
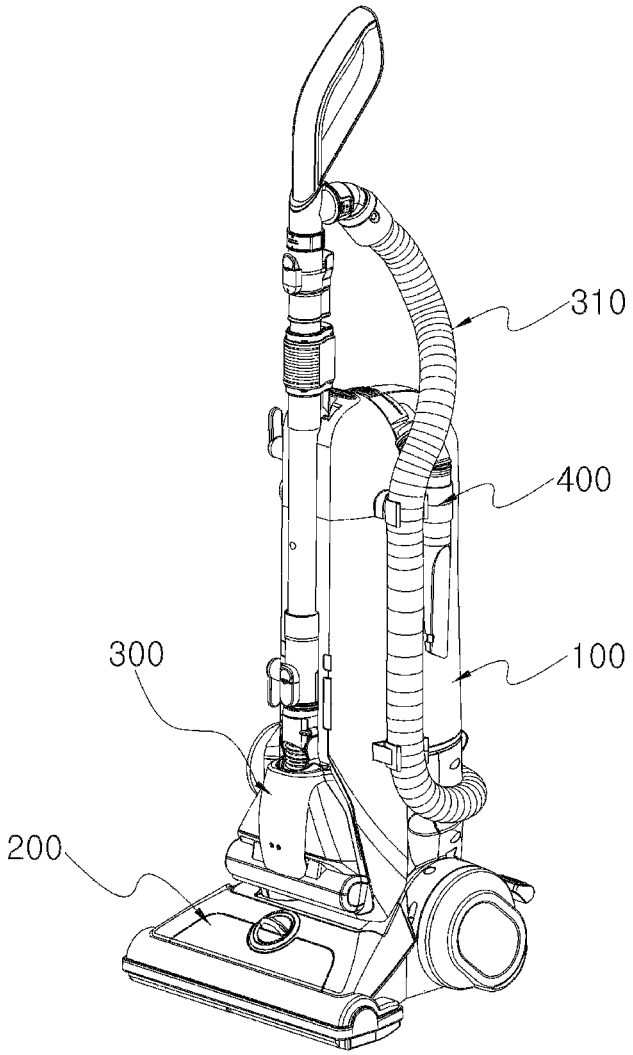
FIG. 1 is a perspective view of an upright vacuum cleaner having a hose and accessory holder constructed in accordance with an embodiment.
Figure 2:
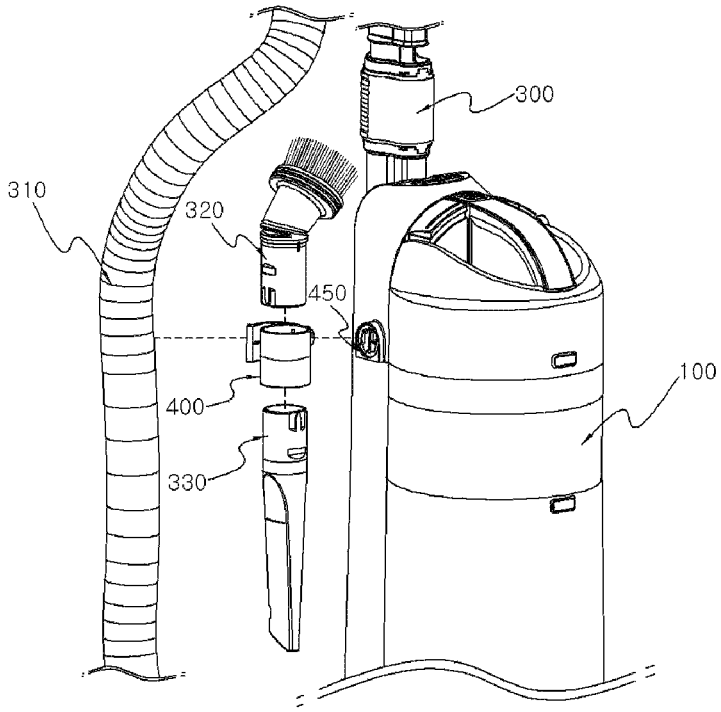
FIG. 2 is a perspective view of components connected to the holder.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of well-known functions and constructions may be omitted for increased clarity and conciseness.

Reference will now be made in detail to the example embodiments, examples of which are illustrated in the drawings, wherein like reference numerals refer to like elements throughout.

When cleaning a floor with an upright vacuum cleaner, a user may hold a handle portion and perform cleaning using a main nozzle unit 200 with a vacuum cleaner body 100 slightly inclined backwardly. When cleaning a narrow area that cannot be cleaned using the main nozzle unit 200, such as a crevice, furniture, or a vehicle, the user performs cleaning using an auxiliary suction nozzle 300 separated from the vacuum cleaner body 100.

As illustrated in FIG. 1, a suction nozzle with a similar shape to that of the main nozzle unit 200 may be used as a head portion of the auxiliary suction nozzle 300. In addition, the head portion of the auxiliary suction nozzle unit 300 may be replaced by a brush tool 320 or a crevice tool 330 in accordance with the type of area to be cleaned.

Figure 3:
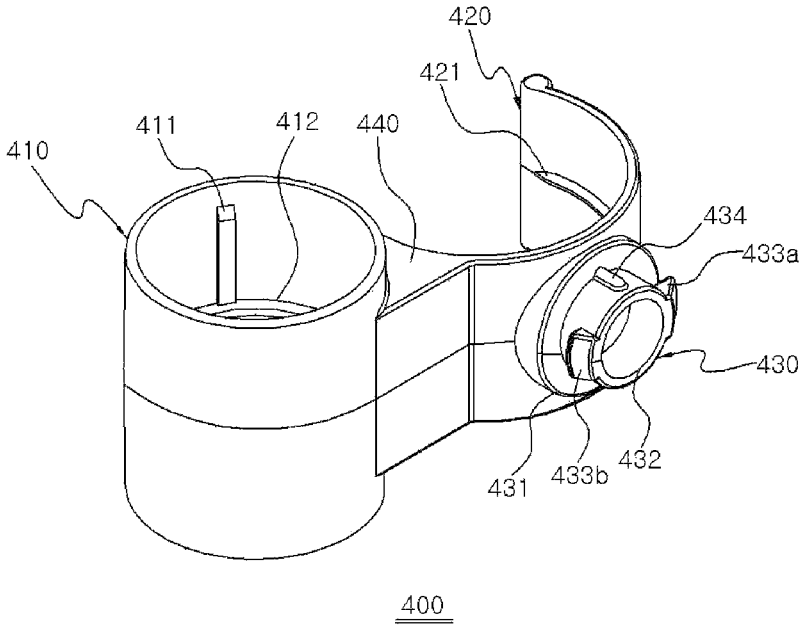
FIG. 3 is a perspective view of the holder.
Figure 4:
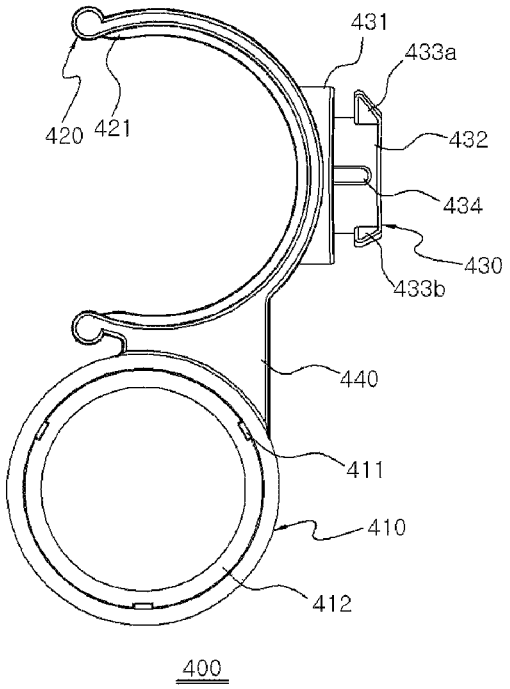
FIG. 4 is a plan view of the holder.
Figure 5:
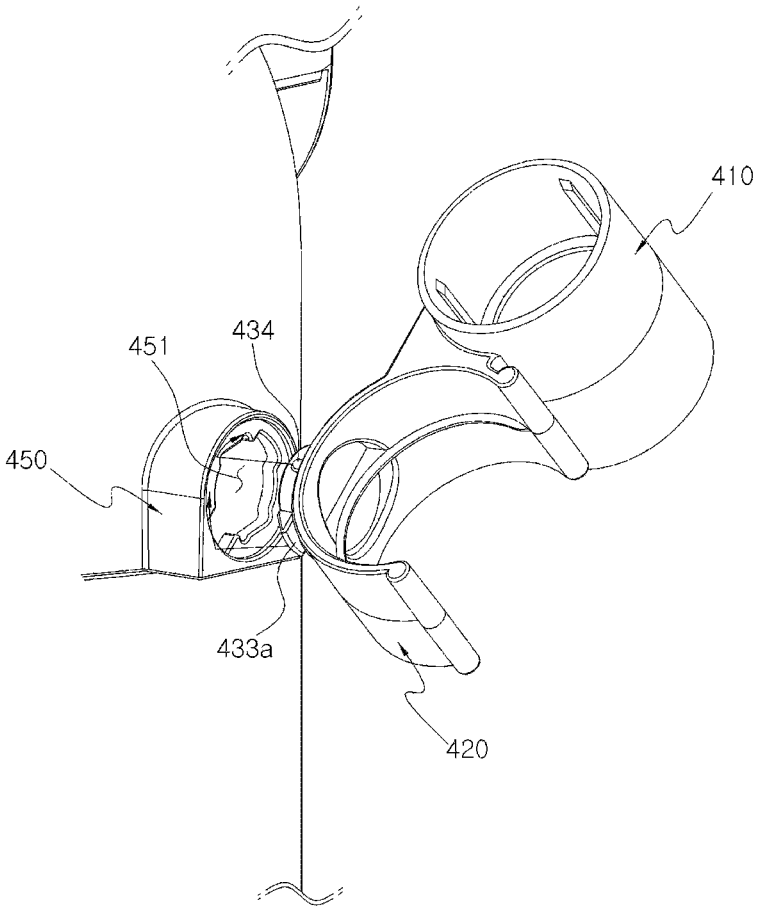
FIG. 5 is a perspective view illustrating a method of fastening the holder to a vacuum cleaner body.

Referring to FIGS. 3 and 4, a holder 400 is provided with a hose fixing portion 420. When performing cleaning using the main nozzle unit 200, or when the vacuum cleaner is not in use, a hose 310 may be fixed to the hose fixing portion 420, and the accessory tools 320 and 330, which are not in use, may be inserted into a tool fixing portion 410.

The holder 400 is provided with a holder fastening portion 430 to be attached to, or detached from, the vacuum cleaner body 100. The tool fixing portion 410 is formed as a cylindrical sleeve, and two accessory tools 320 and 330 may be inserted respectively into upper and lower portions of the tool fixing portion. The inside diameter of the tool fixing portion 410 is sized so that the accessory tools 320 and 330 can be fitted into the tool fixing portion. However, it is not easy to adjust the inside diameter of the tool fixing portion. In addition, the tool fixing portion 410 can become loose due to repeated attachments/detachments, in which case the accessory tools 320 and 330 could fall off the tool fixing portion when the vacuum cleaner is moved.

In order to solve such a problem, a respective fitting member 411 is formed inside the tool fixing portion 410 in the direction in which the accessory tools 320 and 330 are inserted into the tool fixing portion. Each fitting member 411 is formed of a soft plastics or rubber material. One end of the tool fixing portion 410 is rounded or inclined so that each of the accessory tools 320 and 330 can be smoothly inserted into the tool fixing portion 410.

A stopper 412 protrudes inwardly from the tool fixing portion 410 at the center of its inner circumferential surface. The stopper 412 is used to adjust the insertion lengths of the accessory tools 320 and 330 inserted respectively into the upper and lower portions of the tool fixing portion 410. When one of the accessory tools 320 and 330 is inserted too deeply into the tool fixing portion 410, it may be difficult to be removed, and the space for inserting the other tool may be reduced. In order to solve such a problem, the tool fixing portion 410 is partitioned into the upper and lower portions by forming the stopper 412 at the center of the inner circumferential surface of the tool fixing portion 410.

A hose fixing portion 420 is disposed at one side of the tool fixing portion 410. A reinforcing rib 440 is formed at the connection portion of the tool fixing portion 410 and the hose fixing portion 420, so that it is possible to prevent the holder 400 from being deformed due to repetitive uses.

The hose fixing portion 420 has one open end and is formed in a circular arc shape. Hence, the hose fixing portion 420 itself has resilience. Thus, if the hose 310 is pushed into an opening of the hose fixing portion 420 so as to fix the hose 310, the hose is inserted into the opening of the hose fixing portion while the open end of the hose fixing portion is widened on both sides. After the hose 310 is inserted into the opening of the hose fixing portion 420, the hose fixing portion is tightly fixed to an outer circumferential surface of the hose 310, while being restored to the original configuration because of its resilience.

An anti-slide member 421 is formed at an inner circumferential surface of the hose fixing portion 420. Although the hose fixing portion 420 is fixed to the hose 310 by its resilience, the hose may be slid in the upper/lower direction of the hose fixing portion due to the movement of the vacuum cleaner during cleaning. Such a problem may occur when cleaning is performed using the auxiliary suction nozzle 300 when the holder 400 is separated from the vacuum cleaner body 100 and fixed to the hose 310.

The anti-slide member 421 protrudes by a predetermined distance inside the hose fixing portion 420. Thus, if the hose 310 is fixed to hose fixing portion 420, the anti-slide member 421 is inserted into a groove portion of the spiral hose 310, it is possible to prevent the hose from being slid in the axial direction thereof.

Front ends of the anti-slide member 421, which are positioned at an entry portion through which the hose 310 is inserted into the hose fixing portion 420, are rounded or inclined so that the hose can be smoothly inserted into the hose fixing portion 420.

The holder fastening portion 430 is formed at an outer circumferential surface of the hose fixing portion 420, and includes a base member 431 shaped to provide a flat surface, the base member being provided with reinforcement. A cylindrical fastening member 432 is formed on the base member 431. A pair of fixing projections 433*a* and 433*b* and a pair of guide projections 434 are formed on outer circumferential surfaces of the fastening member 432. The fixing projections 433*a* and 433*b* are respectively positioned at the right and left horizontal sides of the holder 400, and the guide projections 434 are respectively positioned at upper and lower sides of the holder.

Figure 6:
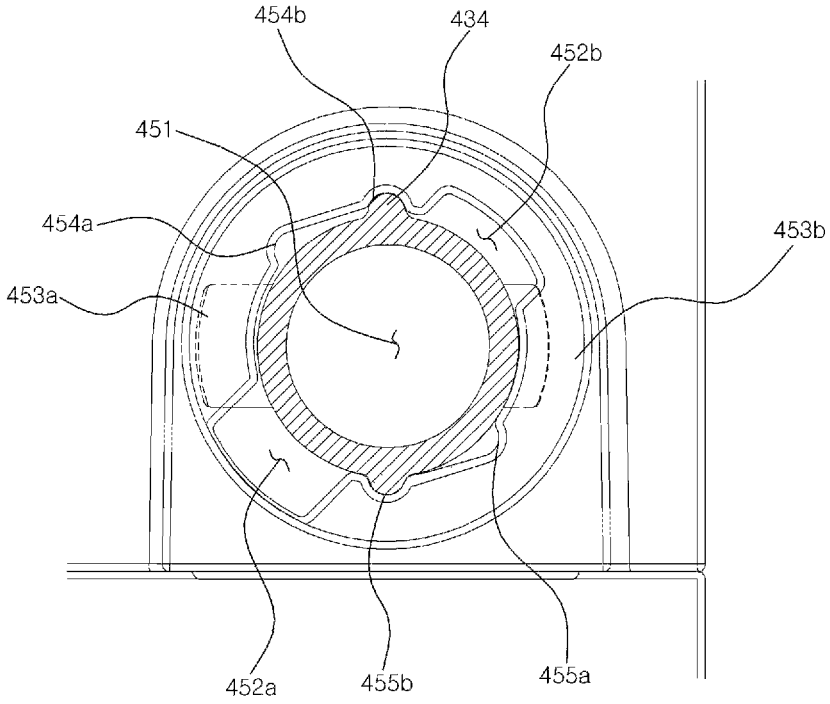
FIG. 6 is a sectional view illustrating how the holder is fastened to the vacuum cleaner body.

When fastening the holder 400 to the vacuum cleaner body 100, the fixing projections 433*a* and 433*b* of the holder fastening portion 430 are inserted into hole extension portions 452*a* and 452*b* of a fastening hole 451 (see FIG. 6) formed in the vacuum cleaner body 100. The fixing projections 433*a* and 433*b* are then rotated until they reach the positions of fixing projection support portions 453*a* and 453*b*. The rotation angle is adjusted by moving the guide projections 434 from guide grooves 454*a* and 455*a* to guide grooves 454*b* and 455*b*. If the guide projections 434 are seated on the respective guide grooves 454*b* and 455*b*, it is possible to prevent the holder 400 from being moved in the rotation direction after the holder is fastened to the vacuum cleaner body 100.

In this embodiment, the size of the fixing projection 433*a* is larger than that of the fixing projection 433*b*. Accordingly, the sizes of the hole extension portions 452*a* and 452*b* are different. The holder 400 of this embodiment is formed to be vertically symmetrical and hence the insertion direction of the holder 400 may be confused by a user. If the holder 400 is fastened to the vacuum cleaner body 100 with the insertion direction of the holder 400 changed (so that the hose fixing portion 420 is positioned at the right hand side as seen in FIG. 1), the tool fixing portion 410 is positioned at the front of the vacuum cleaner body 100, and so, the appearance of the vacuum cleaner may be spoiled. In order to solve such a problem, each of the fixing projections 433*a* and 433*b* and the hole extension portions 452*a* and 452*b* have different sizes, thereby ensuring that the holder 400 is always guided so as to be fastened to the vacuum cleaner body 100 in a constant direction.

The use of the holder 400 will now be described.

When a user is not using the vacuum cleaner or when the user performs cleaning using the main nozzle unit 200, the holder 400 is tightly fastened to the vacuum cleaner body 100 while fixing the hose 310 and holding the accessory tools 320 and 330 that are not in use.

When the user performs cleaning using the auxiliary suction nozzle 300, the auxiliary suction nozzle is separated from the vacuum cleaner body 100, and the hose 310 is separated from the holder 400. At this time, the holder 400 is fastened to the vacuum cleaner body 100, while holding only accessory tools.

The user may not separate only the hose 310 from the holder 400, but may separate the holder 400 itself from the vacuum cleaner body 100. In this case, the holder 400 is used while connected to the hose 310 together with the accessory tools. When the cleaning using the auxiliary suction nozzle 300 is finished, it is then connected to the vacuum cleaner body 100. The holder 400 is also fastened to a housing 450 surrounding the fastening hole 451, thereby serving as a holder for the hose 310.

As described above, a hose and accessory tools 320 and 330 can be attachably/detachably connected to the holder 400, and the holder can be connected to the vacuum cleaner body 100, or to the hose depending on the user's demands. Since the holder 400 is integrally formed with an accessory holder, it is possible to prevent the appearance of the vacuum cleaner from being complicated.

Furthermore, since fitting members 411 are formed in the tool fixing portion 410, it is easy to insert the accessory tools 320 and 330 into the tool fixing portion, and the accessory tools can be fixed to the tool fixing portion after the insertion. Since a stopper 412 is formed at the center of the inner circumferential surface of the tool fixing portion 410, the insertion length of each of the accessory tools 320 and 330 can be adjusted.

Furthermore, since the holder 400 is fastened to the vacuum cleaner body 100 by inserting and then rotating the holder, the holder can be attachably/detachably fastened to the vacuum cleaner body, and the holder can be tightly fastened to the vacuum cleaner body so that it does not fall off due to the movement of the vacuum cleaner.

While there have been illustrated and described what are considered to be example embodiments, it will be understood by those skilled in the art, and as technology develops, that various changes and modifications may be made, and equivalents may be substituted for elements thereof without departing from the scope of embodiments. Many modifications, permutations, additions and sub-combinations may be made to adapt the teachings of embodiments to a particular situation without departing from the scope thereof.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A hose and accessory tool holder combined with a vacuum cleaner, the holder comprising:

a tool fixing portion configured to fix accessory tools that are inserted therein, the tool fixing portion comprising one or more fitting members on inner circumferential surfaces thereof, the fitting members protruding inwardly from the inner circumferential surfaces of the tool fixing portion and being oriented in a direction in which the accessory tools are inserted;

a hose fixing portion configured to fix a hose; and a holder fastening portion affixed to the tool fixing portion and the hose fixing portion, the holder fastening portion being affixed to a vacuum cleaner body.

2. The holder of claim 1, wherein the tool fixing portion further comprises a stopper oriented in a direction that is perpendicular to that of the fitting members, the stopper protruding inwardly at a center portion of the inner circumferential surface of the tool fixing portion the stopper being configured to adjust an insertion length of the accessory tools.

3. The holder of claim 1, wherein the hose fixing portion further comprises an inner circumferential surface comprising one or more anti-slide members, the anti-slide members protruding inwardly from the inner circumferential surface of the hose fixing portion and being configured to prevent the fixed hose from sliding.

4. The holder of claim 3, wherein the anti-slide members are along a central horizontal plane of the inner circumferential surface of the hose fixing portion, and wherein the anti-slide members are further configured to fit into a groove of the fixed hose.

5. The holder of claim 1, wherein the holder fastening portion comprises a cylindrical fastening member, the cylindrical fastening member comprising fixing projections and guide protections on outer circumferential surfaces thereof.

6. The holder of claim 5, wherein a pair of the fixing projections are symmetrical with each other along a horizontal plane of the cylindrical fastening member.

7. The holder of claim 5, wherein a pair of the guide projections are formed to be symmetrical with each other along a vertical plane of the cylindrical fastening member.

8. The holder of claim 5, wherein the cylindrical fastening member is on a base member on an outer circumferential surface of the hose fixing portion.

9. The holder of claim 5, further comprising:

a reinforcing rib formed at a connection portion of the hose fixing portion and the tool fixing portion.

10. The holder of claim 1, wherein the holder fastening portion is further configured to attachably fasten to and detachably unfasten from a fastening hole case on the vacuum cleaner body by being inserted into the fastening hole case and rotated inside the fastening hole case to a predetermined angle.

11. The holder of claim 10, wherein the holder fastening portion is inserted into the fastening hole case from an outer portion of the fastening hole case, the fastening hole case being provided at one side surface of the vacuum cleaner body.

12. The holder of claim 11, wherein hole extension portions are on an outer circumferential surface of the fastening hole case, wherein fixing projections of the holder fastening portion are respectively inserted into the hole extension portions when fixing the tool fixing portion and the hose fixing portion to the vacuum cleaner body, wherein fixing projection support positions are on the outer circumferential surface of the fastening hole case, the fixing projection support positions being configured to respectively support the fixing projections when fixing the tool fixing portion and the hose fixing portion to the vacuum cleaner body, and wherein guide groves are on the outer circumferential surface of the fastening hole case the guide groves being configured to respective guide guide projections of the holder fastening portion, the guide projection being configured to move from insertion portions of the fastening hole case to fastening positions of the fastening hole case when fixing the tool fixing portion and the hose fixing portion to the vacuum cleaner body.

13. The holder of claim 1, wherein, if the hose is inserted into an opening of the hose fixing portion, the opening of the hose fixing portion expands from a width to accept the hose and contracts to the width to affix itself to an outer circumferential surface of the accepted hose, thereby fixing the hose.

* * * * *